US009801424B2

(12) United States Patent
Mazzarolo et al.

(10) Patent No.: US 9,801,424 B2
(45) Date of Patent: Oct. 31, 2017

(54) HELMET PROVIDED WITH AN ADJUSTABLE DEVICE FOR THE HELMET COMFORT LINER

(71) Applicant: ALPINESTARS RESEARCH SRL, Coste di Maser (IT)

(72) Inventors: Giovanni Mazzarolo, Coste di Maser (IT); David Rogers, Boston, MA (US); Duco Noordzij, Roxbury, MA (US)

(73) Assignee: ALPINESTARS RESEARCH SRL, Coste di Maser (IT)

( * ) Notice: Subject to any disclaimer, the term of this patent is extended or adjusted under 35 U.S.C. 154(b) by 0 days.

(21) Appl. No.: 14/370,377

(22) PCT Filed: Dec. 28, 2012

(86) PCT No.: PCT/IB2012/057784
§ 371 (c)(1),
(2) Date: Jul. 2, 2014

(87) PCT Pub. No.: WO2013/102834
PCT Pub. Date: Jul. 11, 2013

(65) Prior Publication Data

US 2014/0366252 A1 Dec. 18, 2014

(30) Foreign Application Priority Data

Jan. 4, 2012 (IT) ..... TV2012A0001

(51) Int. Cl.
*A43B 3/10* (2006.01)
*A42B 3/12* (2006.01)
(Continued)

(52) U.S. Cl.
CPC ..... *A42B 3/12* (2013.01); *A42B 1/22* (2013.01); *A42B 3/10* (2013.01); *A42B 3/125* (2013.01); *A42B 3/127* (2013.01); *A42B 3/145* (2013.01)

(58) Field of Classification Search
CPC ..... A42B 3/127; A42B 3/14; A42B 3/142; A42B 3/12; A42B 3/10; A42B 3/125;
(Continued)

(56) References Cited

U.S. PATENT DOCUMENTS 2,601,872 A * 7/1952 Kaufmann ..... 139/88
3,175,225 A * 3/1965 Lindblom ..... A42B 3/14 2/416
(Continued)

FOREIGN PATENT DOCUMENTS

WO 2010122586 A1 10/2010

OTHER PUBLICATIONS

PCT International Search Report and Written Opinion dated May 27, 2013, from which the instant application is based, 7 pgs.

*Primary Examiner* — Clinton T Ostrup
*Assistant Examiner* — Jillian K Pierorazio
(74) *Attorney, Agent, or Firm* — Fredrikson & Byron, P.A.

(57) ABSTRACT

A helmet which includes an impact absorbing liner and a comfort liner. The comfort liner in turn includes at least one adjustable device which during the normal use of the helmet is positioned on the top of the head of the user. The adjustable device is suitable for being fastened to the impact absorbing liner of the helmet by coupling suitable for being removably engaged on the impact absorbing liner of the helmet via a plurality of anchor points. By changing the anchor point where the adjustable device is engaged, the
(Continued)

user is allowed to adjust the conformation and slope of the adjustable device of the helmet according to his own needs.

23 Claims, 13 Drawing Sheets

(51) Int. Cl.
*A42B 1/22* (2006.01)
*A42B 3/14* (2006.01)
*A42B 3/10* (2006.01)

(58) Field of Classification Search
CPC ..... A42B 3/145; Y10T 24/4599; Y10T 24/45969; Y10T 24/45796; Y10T 24/3463
USPC ..... 2/414, 418–420, 76, 325, 128, 220, 2/171.7, 181.4, 417, 416; 24/706
See application file for complete search history.

(56) References Cited

U.S. PATENT DOCUMENTS 3,430,260 A * 3/1969 Stropkay ..... A42B 3/14 2/416
3,497,873 A * 3/1970 Benner ..... A42B 3/14 2/414
3,685,055 A * 8/1972 Militello ..... A42C 5/02 2/181.4
3,878,562 A * 4/1975 Lamb ..... A42B 3/14 2/416
4,055,860 A * 11/1977 King ..... A42B 3/14 2/416
4,463,456 A * 8/1984 Hanson ..... A42B 3/14 2/416
RE32,569 E * 1/1988 Aileo ..... A42B 3/14 2/171.1
4,803,118 A * 2/1989 Sogi et al. ..... 442/189
5,113,534 A * 5/1992 Lane et al. ..... 2/416
5,517,698 A 5/1996 Nault et al.
5,555,569 A * 9/1996 Lane ..... A62B 18/084 128/201.22
5,619,754 A * 4/1997 Thurwanger ..... A42B 3/085 2/416
5,694,649 A * 12/1997 Hefling ..... A42B 3/145 2/418
5,774,900 A * 7/1998 Wu ..... A42B 3/06 2/171.3
6,032,297 A * 3/2000 Barthold et al. ..... 2/416
6,279,172 B1 * 8/2001 Epperson ..... A42B 3/12 2/410
6,353,978 B1 * 3/2002 Kawahara et al. ..... 24/114.4
6,374,423 B1 * 4/2002 Anderson ..... A42B 3/227 2/12
7,213,271 B1 * 5/2007 Bielefeld ..... A42B 3/14 2/181
8,087,099 B2 * 1/2012 Sawabe ..... A42B 3/127 2/411
2005/0141191 A1 * 6/2005 Long et al. ..... 361/690
2006/0162054 A1 7/2006 Lardeau
2009/0158506 A1 * 6/2009 Thompson ..... A42B 3/127 2/411
2009/0222978 A1 * 9/2009 Fang ..... 2/421
2010/0229286 A1 * 9/2010 Ahlgren ..... A42B 3/142 2/416
2012/0297520 A1 * 11/2012 Gleason ..... A42B 3/142 2/181
2013/0219596 A1 * 8/2013 Carvell ..... A42B 3/14 2/416
2014/0109301 A1 * 4/2014 Hall ..... A42B 3/142 2/416

* cited by examiner

HELMET PROVIDED WITH AN ADJUSTABLE DEVICE FOR THE HELMET COMFORT LINER

RELATED APPLICATIONS

This application is a 35 U.S.C. 371 national stage filing from International Application No. PCT/IB2012/057784 filed Dec. 28, 2012 and claims priority to Italian Application No. TV2012A000001 filed Jan. 4, 2012, the teachings of which are incorporated herein by reference.

FIELD OF THE INVENTION

The present invention relates to a helmet provided with an adjustable device for the helmet comfort liner.

BACKGROUND

As it is well known in the art, the helmets which are used during sporting activities generally utilize a construction based on three primary components: an exterior shell, an impact absorbing liner and a comfort liner.

The exterior shell, made of a rigid material, for example a thermoplastic polymer like polycarbonate or a fiber-reinforced polymer, has the function to protect the head of the helmet's wearer against impacts with the ground or other objects.

The exterior shell is also suitable for dissipating, at least partially, in case of an accident, the impact forces acting on the helmet by spreading and transferring them to the second component of the helmet, the impact absorbing liner.

The impact absorbing liner is positioned adjacent to the exterior shell and it is shaped so as to correspond to the shape of the wearer's head.

The function of the impact absorbing liner is to absorb the impact forces which are generated during an accident, thereby preserving the wearer's head.

Generally, the impact absorbing liner is made of relatively rigid material, like expanded polystyrene.

The third component is the comfort liner which resides on the surface of the impact absorbing liner facing the wearer's head.

The comfort liner is usually made of a combination of soft foam and fabric materials and has the function to make comfortable the wear of the helmet, by avoiding that the wearer's head gets in direct contact with the rigid impact absorbing liner.

It is also known that a helmet, in order to accomplish in the best way its protection function, needs to be stable and secure on the wearer's head. Such occurrence is possible only when the impact absorbing liner is very close in shape and size to that of the wearer's head. In this case, the comfort liner can be soft and comfortable without affecting the stability of the helmet since it has the support of the rigid impact liner placed beside it.

Nevertheless, considering the variety of sizes and shapes of the heads of the world population, it is quite difficult that a helmet which fits properly on the head of one person, could fit in a stable and secure manner on the head of a another person.

To achieve such result, most helmet manufacturers offer to their customers, even if it is expensive and difficult to do, the opportunity to choose between different sizes and shapes of helmet, in order to increase the possibility that the customer could find a helmet which is stable and secure on its head and at the same time comfortable.

In the name of the same applicant an International Patent Application has been filed (published as WO2010122586) which discloses a new and innovative impact absorbing liner suitable for being used as part of a helmet. Such impact absorbing liner comprises adjustable means which allow to easily change the interior size and shape of the impact absorbing liner. In a preferred embodiment the adjustable means of the impact absorbing liner comprises a plurality of displaceable blocks, positioned in the area of the impact absorbing liner facing the temples, the ears and the occipital bone of the wearer of the helmet. By moving towards or away from the wearer's head the displaceable blocks, it is possible for the wearer to adjust the shape and size of the internal comfort liner according to his/her needs. Such impact absorbing liner allows to solve the drawbacks above mentioned, making a helmet stable and secure over a plurality of different heads.

Nevertheless, it should be noted that even if the head of the user fits properly inside the impact absorbing liner of the helmet, further problems can still arise.

As a matter of fact, also for users having an head with a given proportion, the location of the eyes, ears and face is not constant and varies independently from the size of the head.

The result is that on many users the helmet sits too low on the face. This occurrence can cause unnecessary pressure on the eyebrows of the user and can potentially reduce the field of view, by affecting in this way the safety of the user.

Furthermore, many user may have a head with a given proportion but different top profile. In this case, the shape of the impact absorbing liner and comfort liner, not matching the specific shape of the head, may cause the helmet to sit on the user head at an unusual or uncomfortable angle.

Also this occurrence can lead to some problems. As a matter of fact, some areas of the helmet can exert an unnecessary pressure on the head. Moreover, also in this case, the field of view of the user can be reduced.

Some helmets are provided with one or more pads suitable for being attached by Velcro® means over the top internal surface of the impact absorbing liner.

Nevertheless, the provision of such pads does not solve the above mentioned problems.

As a matter of fact, for being efficacious and for helping the user to adjust the positioning of the helmet over its head, the pads must have different thickness and must be able to be swapped out for one and other.

In view of the above notes, for assuring a proper fitting of the helmet over the user's head, every helmet should be supplied with at least one set of pads having different thickness. Such eventuality would imply an increase of the costs and an useless consumption of material. As a matter of fact, multiple pad thickness would need to be supplied with every helmet, but only one thickness would ever be worn.

BRIEF SUMMARY OF THE INVENTION

The object of the present invention is to provide a helmet which solves at least partially the above mentioned problems and drawbacks.

In particular, an aim of the present invention is to provide a helmet having a comfort liner which can be easily adapted to the top profile of the wearer's head so as to adjust the angle on which the helmet sits on the head of the user.

Moreover, an other aim of the present invention is to provide a helmet having a comfort liner that allows the adjusting of the internal height of the helmet so as to achieve a proper positioning of the helmet with respect to the eyes, ears and face of the user.

These and other objects and aims are achieved by the helmet provided with an adjustable device for the helmet comfort liner according to claim 1.

BRIEF DESCRIPTION OF DRAWINGS

The advantages and the characteristic features of the invention will emerge more clearly from the following description of a preferred, but not exclusive, embodiment of the helmet which refers to the accompanying figures in which.

DETAILED DESCRIPTION OF EMBODIMENTS OF THE INVENTION

In the following description of the helmet according to the invention, as "bottom" there will be indicated the portion of the different components of the helmet relatively closer to the wearers head and as "top" the portion of the different components relatively farther.

With reference first of all to FIGS. 1, 1A and 2, and 2A the present invention relates to a helmet 10 which comprises an impact absorbing liner 30 and a comfort liner 40.

Figure 1:
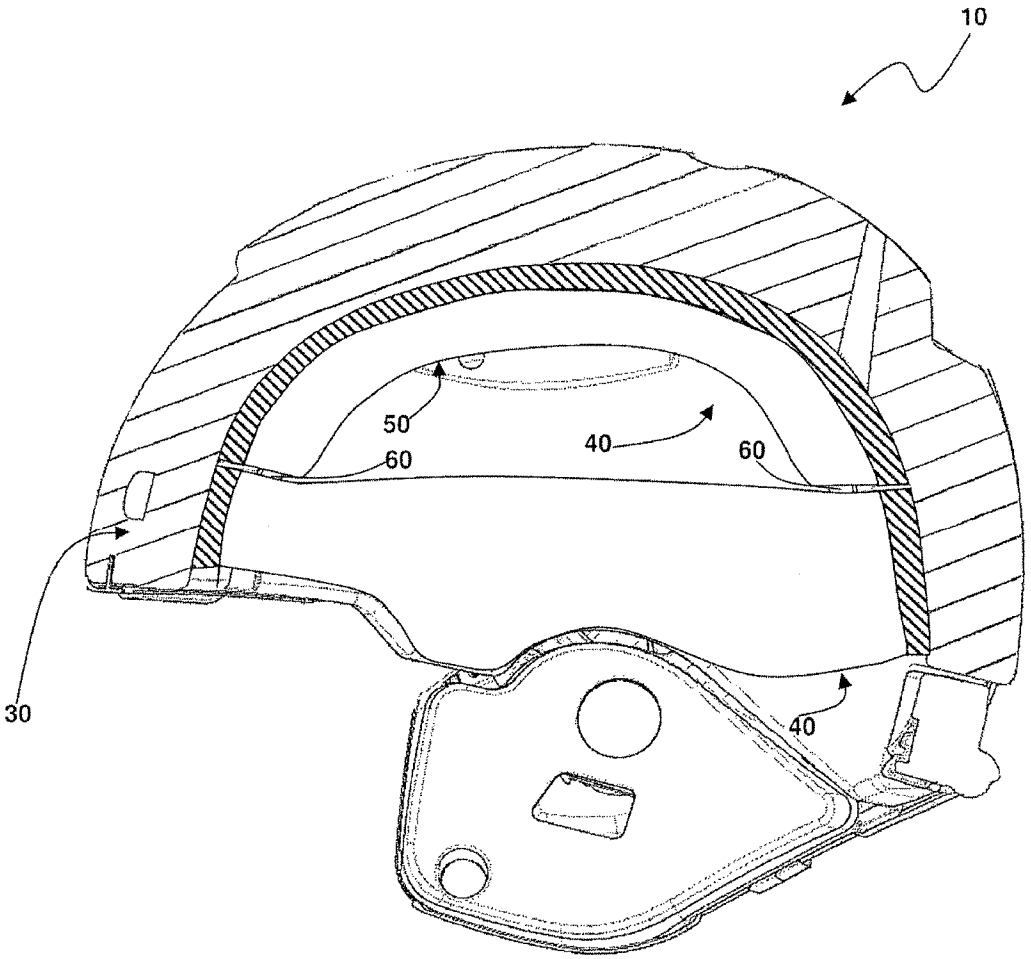
FIG. 1 shows a cross sectional view of a helmet according to the invention.
Figure 1A:
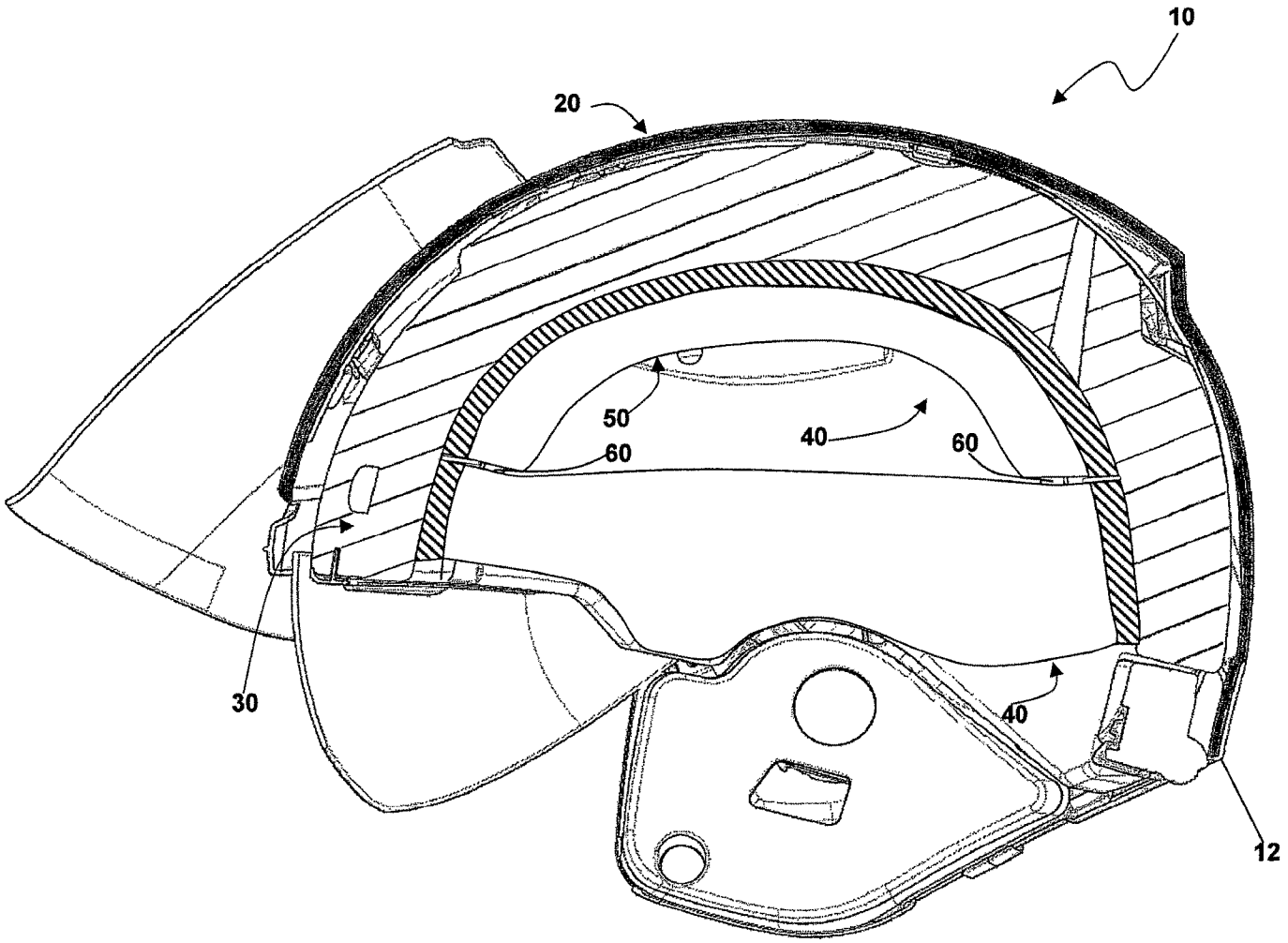
FIG. 1A shows a cross sectional view of the helmet of FIG. 1, comprising an external shell.
Figure 2:
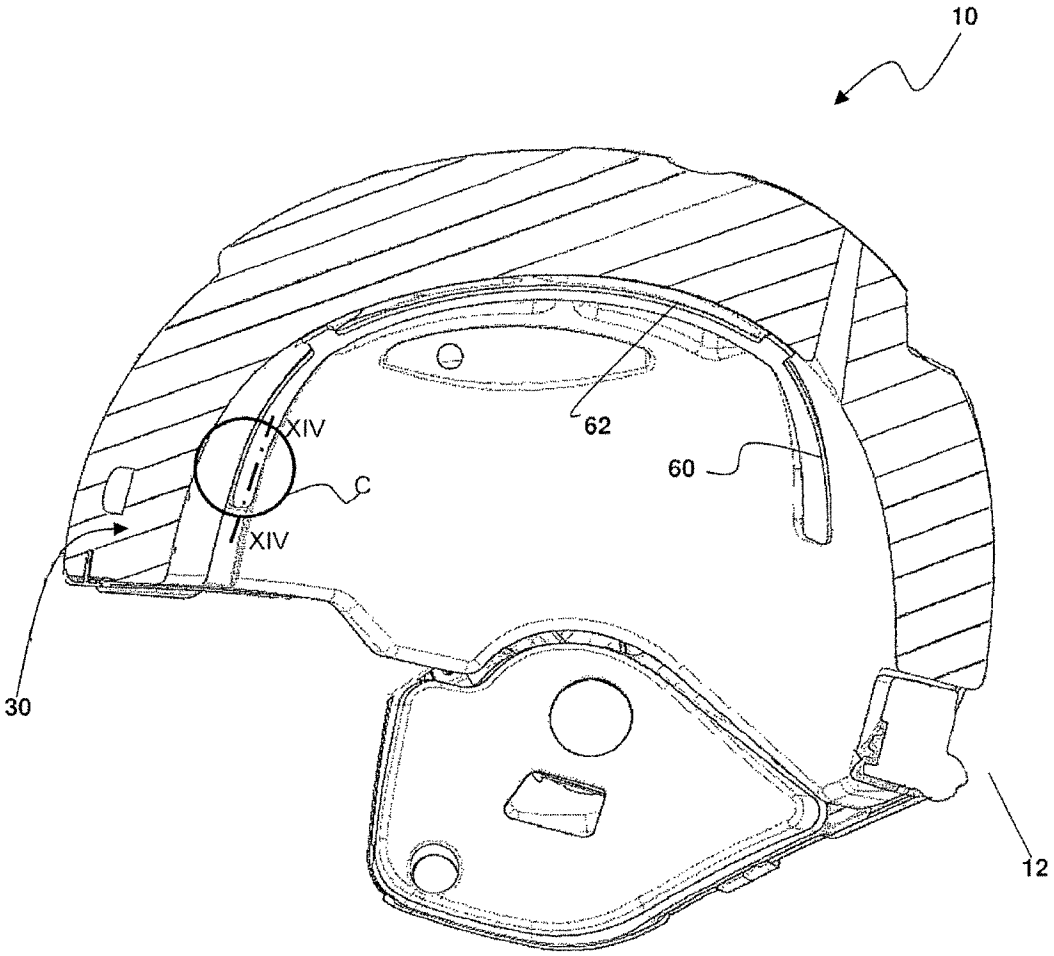
FIG. 2 shows a simplified cross sectional view of the helmet of FIG. 1.
Figure 2A:
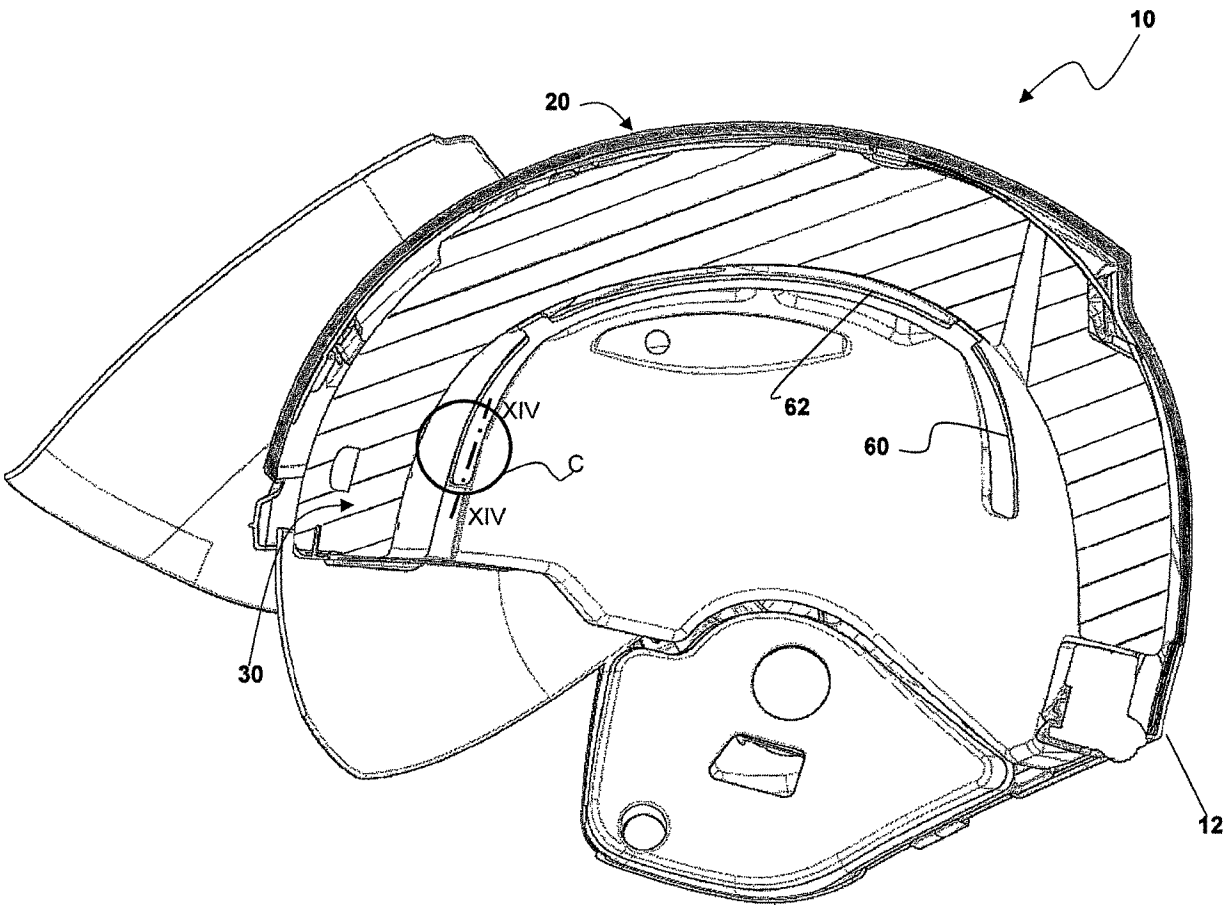
FIG. 2A shows a simplified cross sectional view of the helmet of FIG. 1A.

In a well know manner, as it is shown in FIGS. 1A and 2A, the helmet 10 can also comprise an external shell 20 positioned over the impact absorbing liner 30.

The comfort liner 40 in turn comprises at least one adjustable device 50 which, during the normal use of the helmet 10, is positioned at the top of the head of the user. Preferably, the adjustable device 50 comprises a liner suspension device 60 and a cushioning pad 70 (see FIG. 5).

In FIGS. 2 and 2A, only the liner suspension device 60 of the adjustable device 50 is shown, the other components of the adjustable device 50 having been removed.

Figure 5:
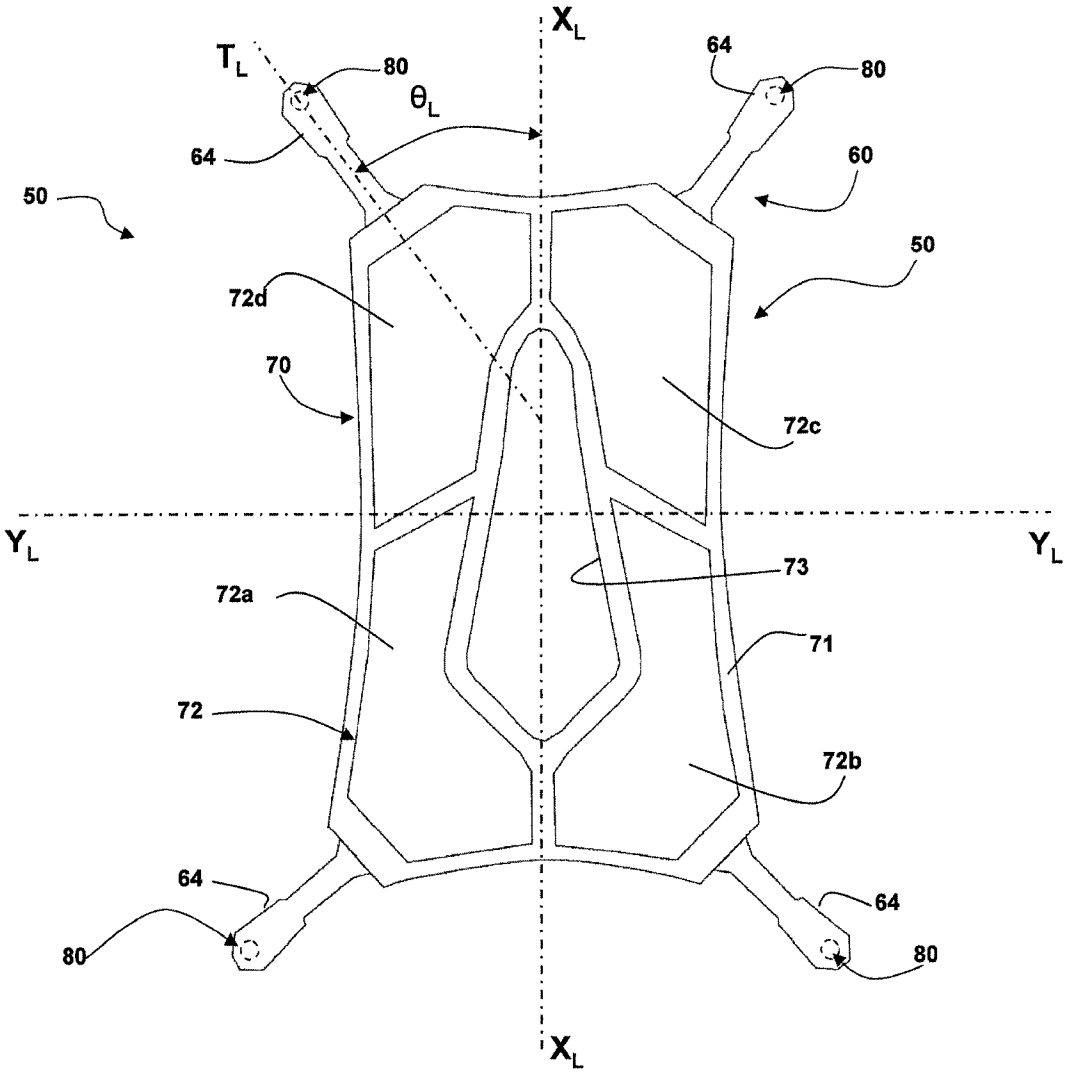
FIG. 5 shows a bottom view of the adjustable device of the helmet comfort liner according to the invention.
Figure 7:
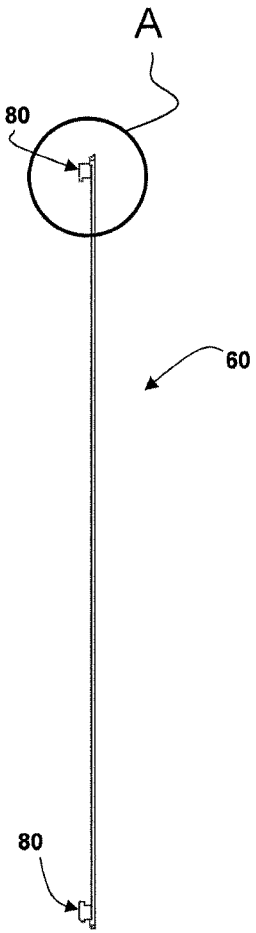
FIG. 7 shows a side view of the component of FIG. 6.
Figure 6:
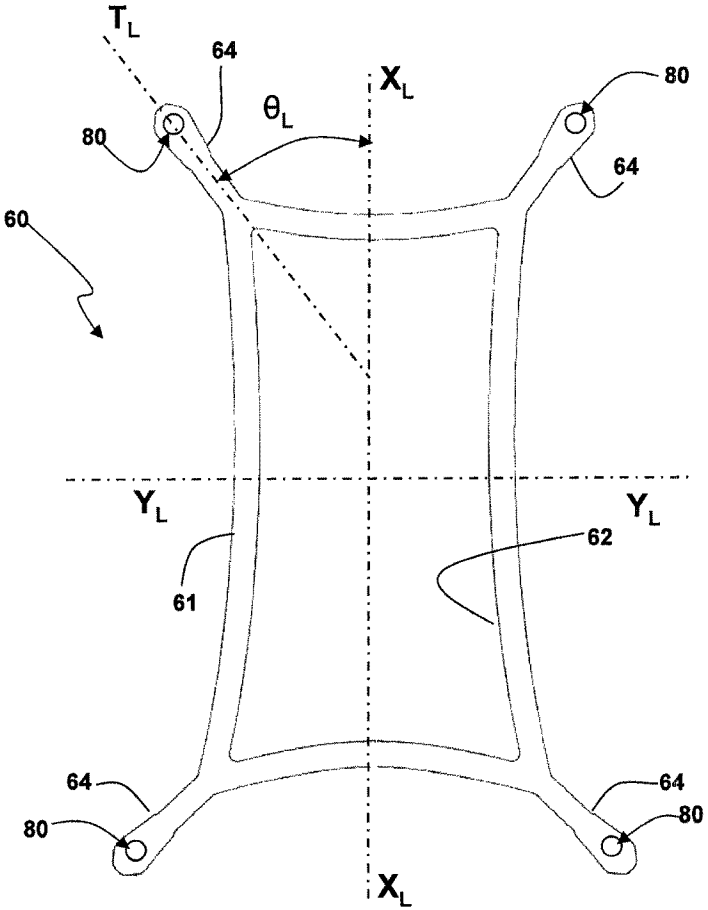
FIG. 6 shows a top view of a first component of the adjustable device of FIG. 5.

According to the invention, the adjustable device 50 is suitable for being fastened to the impact absorbing liner 30 of the helmet 10 by means of coupling means 80 provided at the ends 64 of the adjustable device 50 (see FIG. 5).

In detail, the coupling means 80 are suitable for being removably engaged inside anchor means 90 provided on the impact absorbing liner 30 of the helmet 10.

Each anchor means 90 has a plurality of anchor points 94A, 94B, 94C. Accordingly, by changing the anchor point 94A, 94B, 94C where the coupling means 80 of the adjustable device 50 is engaged, the user is allowed to adjust the conformation and slope of the adjustable device 50 of the helmet 10 according to his own needs. In this way it is possible to adjust the internal height of the helmet and the angle on which the helmet sits on the head of the user.

Figure 4:
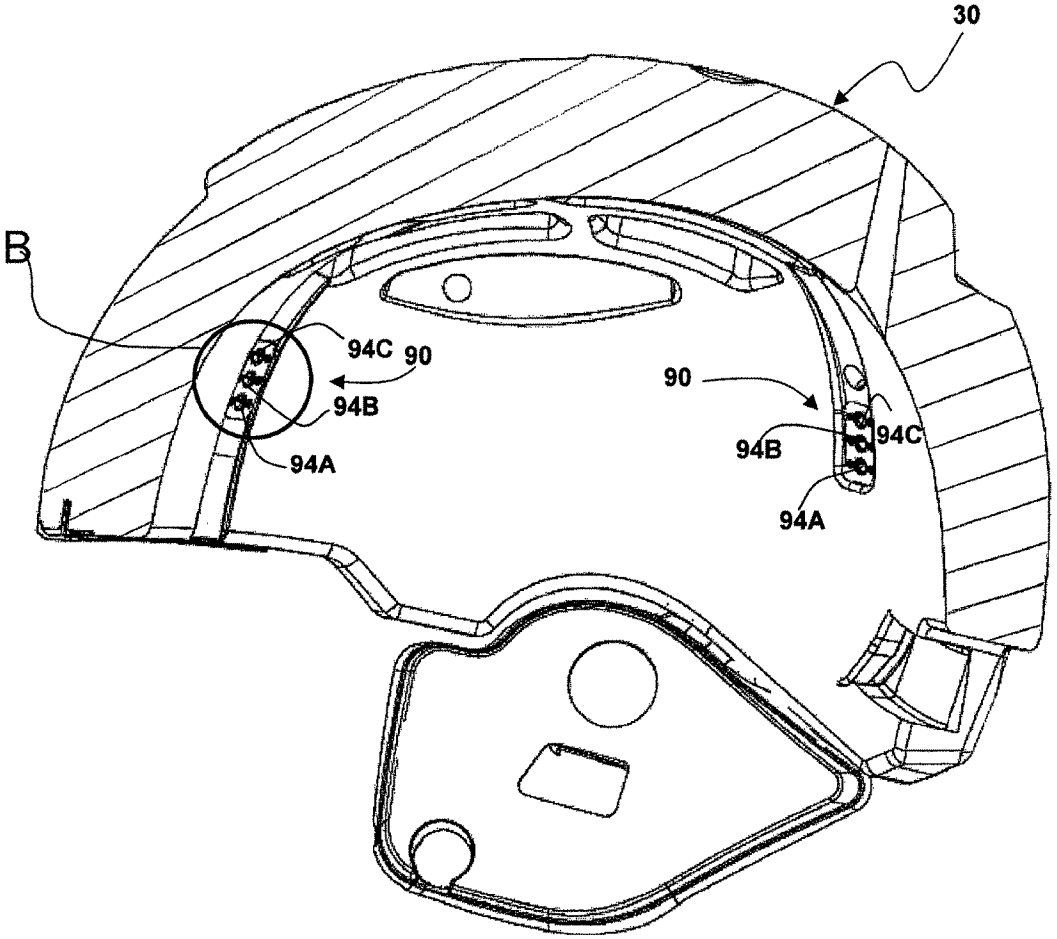
FIG. 4 shows a cross sectional view of the impact absorbing liner of the helmet of FIG. 2.

Preferably, the anchor points 94A, 94B, 94C of each anchor means 90 are positioned at different locations on the impact absorbing liner 30 and spaced apart from each other (see FIG. 4) so as to allow the user a wide range of adjustments of the adjustable device 50.

As anticipated above, the adjustable device 50 can be formed by the liner suspension device 60 and the cushioning pad 70.

The liner suspension device 60 is preferably made of polymeric material and is preferably produced by means of well known injection moulding techniques.

The liner suspension device 60 can have different shapes and dimensions.

As a matter of fact, for a proper functioning of the device 60, it is simply required that the liner suspension device 60 has a shape that allows it to be easily connected to the different anchor means 90 provided on the impact absorbing liner 30, so that the liner suspension device 60 is adequately supported.

At the same time, it is also advisable that the liner suspension device 60 has a surface area having dimensions suitable for supporting the weight of the helmet without creating any contact pressure points over the user's head.

Preferably, the liner suspension device 60 comprises a central body 61, from which protrudes outwardly a plurality of appendix 64, the coupling means 80 of the adjustable device 50 being provided on the top surface of each appendix 64.

As it is shown in FIGS. 2, 2A, 5 and 6, in a preferred embodiment of the invention, the liner suspension device 60 has a substantially rectangular body 61 with a central rectangular opening 62. At each corner of the rectangular body 61 an appendix 64 protrudes outwardly along a direction angled approximately of an angle $\theta_L$ with respect to the longitudinal axis $X_L$ of the body 61. Angle $\theta_L$ is preferably comprised in the range between about 30° and about 50°.

As it is shown in FIG. 5, the bottom surface of the liner suspension device 60 is coupled to a cushioning pad 70 having an external profile which substantially reproduces the external profile of the body 61 of the liner suspension device 60.

The cushioning pad 70 can comprise a top moulded cushion 71 which is partially overlaid by a foam layer 72. The cushioning pad 70 generally further comprises a mesh of fabric material (not shown in the attached figures) which entirely covers the bottom surface of the cushioning pad 70.

The top moulded cushion 71 and the foam layer 72 are preferably stitched together along their perimetric edges.

The coupling between the liner suspension device 60 and the cushioning pad 70 can be made also by means of glue or by means of other known techniques.

In a preferred embodiment of the invention, similarly to the liner suspension device 60, also the cushioning pad 70 is provided with a central opening 73. Such central opening 73 which can have different shapes (in FIG. 5 an opening 73 is shown having a substantially rhomboidal shape) has the function to guarantee an adequate breathability of the adjustable device. As a matter of fact, the opening 73 is designed to be matched with the rectangular opening 62 of the liner suspension device 60.

Preferably the foam layer 72 is split into four separate sections 72*a*, 72*b*, 72*c* and 72*d*.

In this way the adjustable device 50 is more flexible, having a greater surface area suitable for comfortably fitting on the top head of the helmet's wearer.

Generally, the coupling between the liner suspension device 60 and the cushioning pad 70 in order to obtain the adjustable device 50 is made by directly injecting the liner suspension device 60 onto the cushioning pad 70. In this way a firm connection between the two components of the adjustable device 50 is guaranteed.

The adjustable device 50 is suitable for being fastened to the impact absorbing liner 30 of the helmet 10 by means of coupling means 80.

Such coupling means 80, in a preferred embodiment of the invention, are provided on the top surface of each appendix 64 of the liner suspension device 60.

Figure 9:
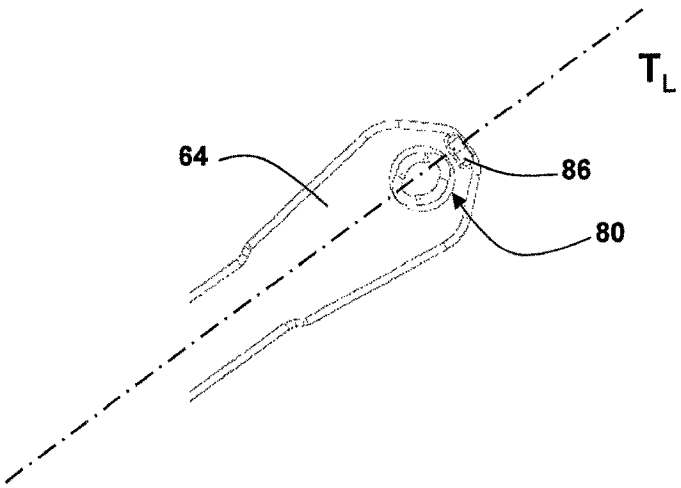
FIG. 9 shows a top view of the detail of FIG. 8.
Figure 10:
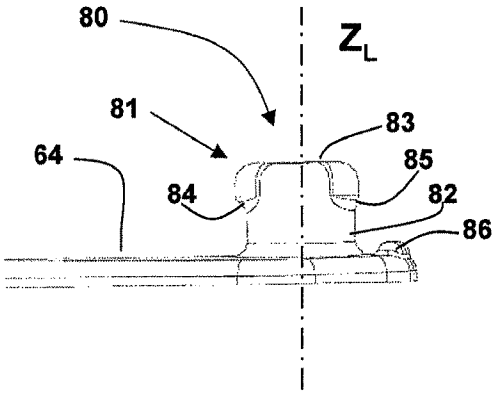
FIG. 10 shows a side view of the detail of FIG. 8.
Figure 8:
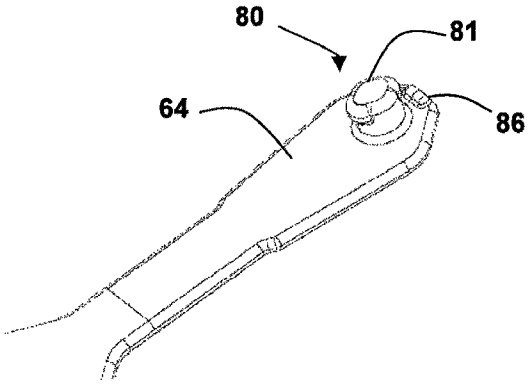
FIG. 8 shows a larger perspective view of the detail referenced by A in FIG. 7.

As it is clearly shown in FIGS. 8-10, the coupling means 80 preferably comprise a first pin 81 having a mushroom shape which extends orthogonally from the top surface of the appendix 64. Preferably the first pin 81 has a stem 82 which bears a rounded head 83 on its free end.

Figure 14:
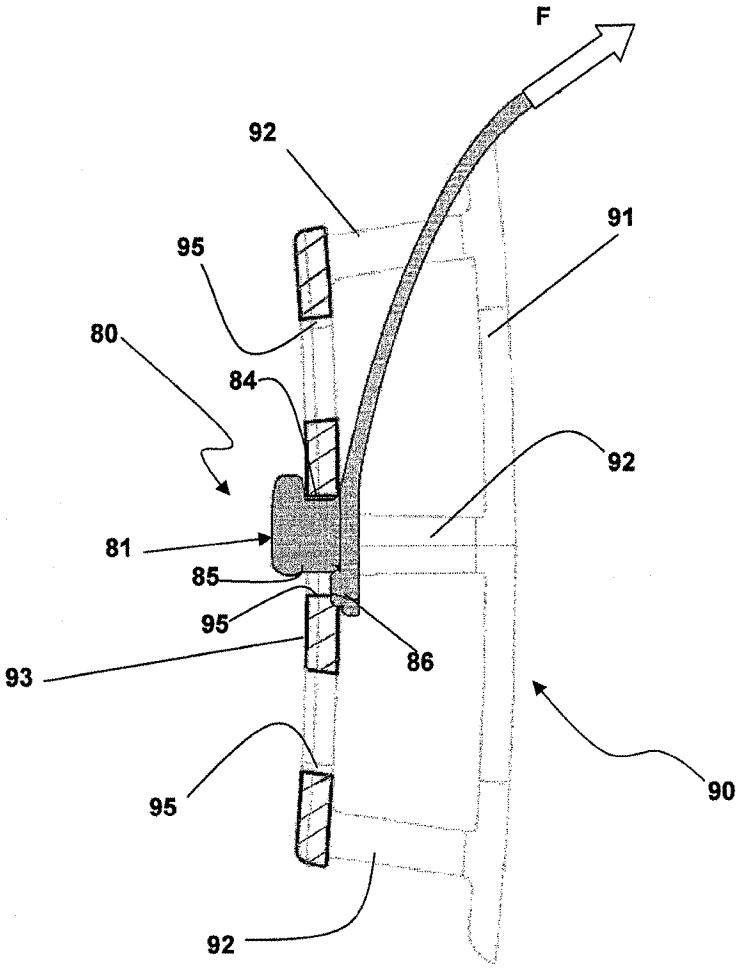
FIG. 14 shows a cross sectional view of the detail referenced by C in FIG. 2 according to plane XIV-XIV of FIG. 2.
Figure 15:
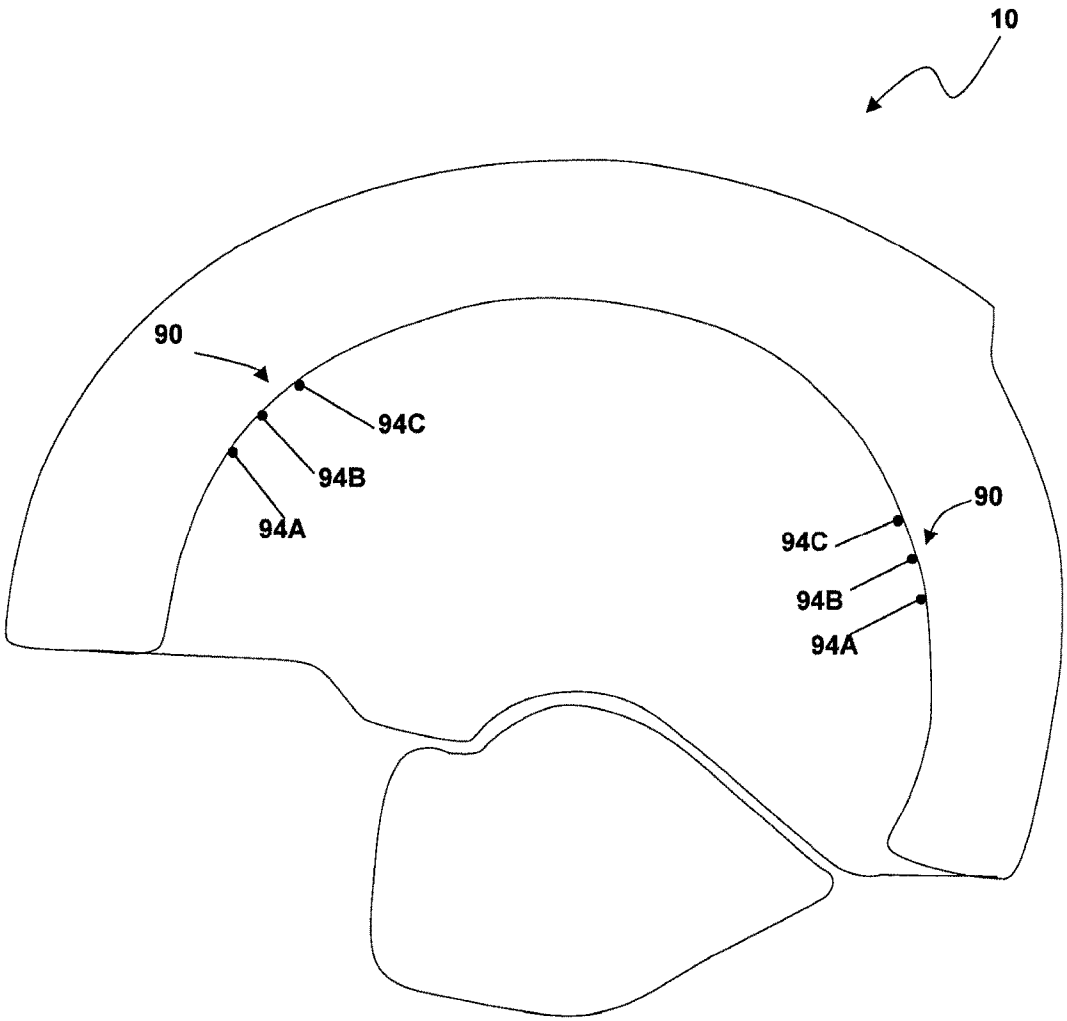
FIG. 15 shows a simplified cross sectional view of the helmet according to the invention.

The rounded head 83 has an asymmetrical shape with respect to the longitudinal axis $Z_L$ of the stem 82. As a matter a fact, as it is shown in FIGS. 10 and 14, the surface 84 of the head 83, facing internally towards the cushioning pad 70, is merged into the stem 82 of the rounded head 83 with a profile more curved with respect to the outward surface 85.

The surface 84 forms a kind of hook which is suitable to offer a firm catch on the anchor means 90, as it will be described in detail in the following.

As it is shown in FIGS. 8-10, a second pin 86 can extend orthogonally from the top surface of each appendix 64, such second pin 86 being facing to the outward surface 85. The second pin 86 has a rounded head having a height lower than that of the first pin 81. The second pin 86 accomplishes, as it will be described in detail in the following, a safety function since it forces, once the first pin 81 is inserted inside the anchor means 90, the surface 84 of the first pin 81 to stay adherent to the anchor means 90, avoiding any bending movements which could cause the unintentional detachment between the first pin 81 and the anchor means 90. The anchor means 90 are fastened in a known manner to the impact absorbing liner 30 of the helmet 10.

In a preferred embodiment of the invention, the anchor means 90 are obtained by injecting polymeric material inside proper seats provided into the impact absorbing liner 30.

In this way, the connection between impact absorbing liner 30 and anchor means 90 is very secure and firm.

Figure 3:
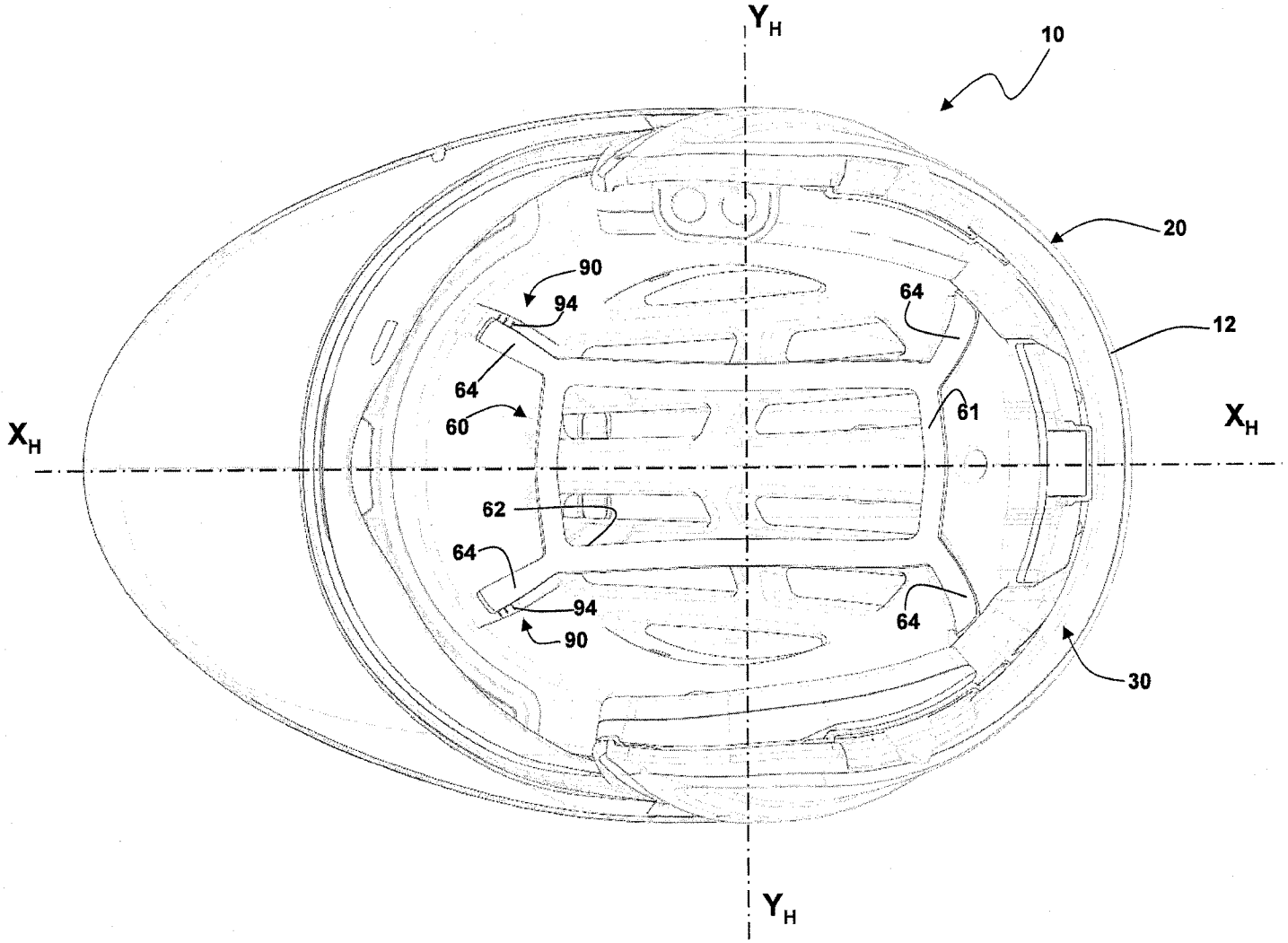
FIG. 3 shows a bottom view of the helmet according to the invention.

The helmet 10 is preferably provided with four different anchor means 90 which are arranged symmetrically two by two with respect to the central vertical symmetry plane of the helmet 10 (see trace $X_H$ in FIG. 3). More precisely, the anchor means 90 are positioned at the front and at the rear of the impact absorbing liner in an area substantially corresponding to the frontal bone and to the occipital bone, respectively.

Figure 12:
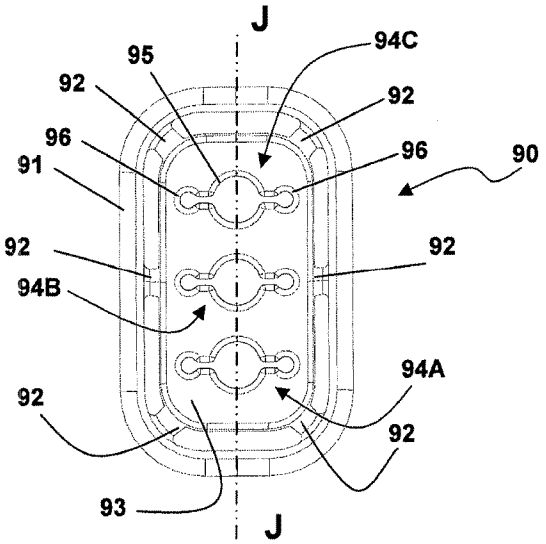
FIG. 12 shows a top view of the detail of FIG. 11.
Figure 13:
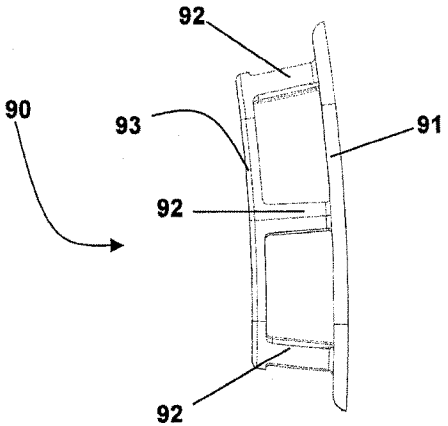
FIG. 13 shows a side view of the detail of FIG. 11.
Figure 11:
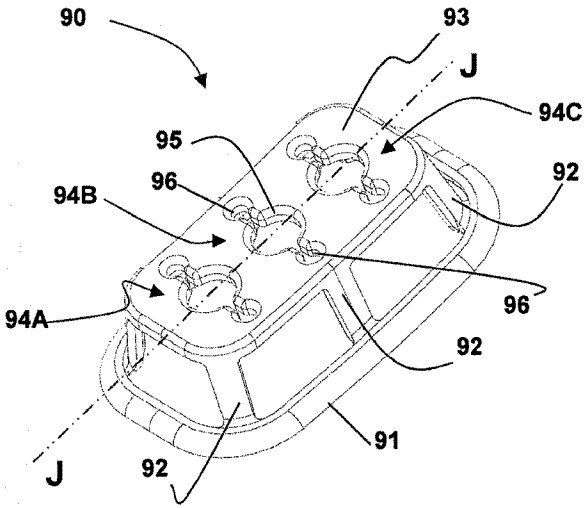
FIG. 11 shows a larger perspective view of the detail referenced by B in FIG. 4.

With reference to the FIGS. 11-12-13 each anchor means 90 has a bottom profile 91, preferably of rectangular shape. Supporting means 92 extend in a direction substantially orthogonal from the top surface of the bottom profile 91. Such supporting means 92 have the function to support an anchor surface 93 along a plane substantially parallel to the plane on which lies the bottom profile 91. Preferably also the anchor surfaces 93 have rectangular shape.

The anchor surface 93 is provided with a plurality of different anchor points 94. Preferably three different anchor points 94A, 94B, 94C are arranged along to the longitudinal axis J of the surface 93.

As it is shown in FIGS. 4 and 15-19, the different anchor points 94A, 94B, 94C are positioned at different locations and spaced apart from each other. As a matter of fact each anchor surface 93 may be provided with a bottom anchor point 94A, a middle anchor point 94B and a top anchor point 94C.

Figure 16:
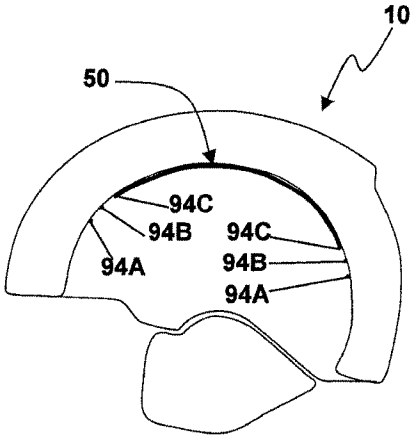
FIGS. 16-19 show four schematic views of some possible adjustments of the adjustable device of the helmet comfort liner according to the invention.
Figure 17:
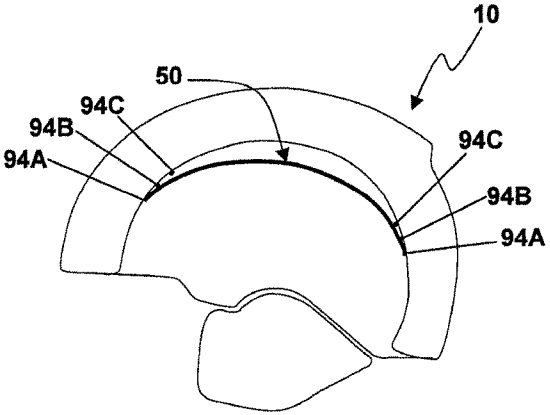

In this way, as it has been previously anticipated, by changing the anchor point 94A, 94B, 94C which is engaged by the coupling means 80 of the adjustable device 50, it is also possible to adjust the internal height of the helmet (see FIGS. 16 and 17). Furthermore, it is also possible to change the angle on which the helmet 10 sits on the head of the user. As a matter of fact, by selecting for example the bottom anchor point 94A of the front anchor means and the top anchor point 94C of the rear anchor means, the slope of the adjustable device 50 can be changed helping in this way the wearer to customize the helmet 10 according its needs (see FIG. 18).

In particular, each anchor point 94 may be composed by a central hole 95 to which two smaller holes 96 extend symmetrically in a direction perpendicular to the longitudinal axis J. The diameter of the central hole 95 is smaller than the outer profile of the rounded head 83 of the first pin 81, as a consequence, in order to couple the first pin 81 to the central holes 95 a slight push action is needed.

The provision of the two smaller side holes 96 permits the bending of the central hole 95 allowing the insertion of the pin 81 but, at the same time, preserves the stiffness of the anchor point 94.

As a matter of fact, the first pin 81 can be released only by exerting a pull action that is directed along a normal direction to the plane on which the central holes 95 lie.

Moreover, the specific shape of the anchor points 94 allows the central holes 95 of each anchor point 94 to be positioned closer together. In this way, it is offered to the wearer the possibility to make an accurate adjustment of the adjustable device.

Hereafter the operation of the adjustable device 50 of the comfort liner 40 of the helmet 10 will be described.

When the user wears the helmet 10, he has to check whether the helmet 10 is stable and secure on his head. As a matter of fact, as mentioned before, even if the size of the helmet 10 fits quite properly on the user's head, there is the possibility that the top portion of the comfort liner 40 of the helmet 10 has a different profile than the top portion of the user's head or, alternatively, that the comfort liner 40 exerts an excessive pressure against the top portion or the face of the user's head.

In the first case the helmet sits on the user's head at an unusual or uncomfortable angle. In the second case the pressure exerted by the comfort liner 40 does not allow to the user to wear the helmet 10 in a comfortable manner. In addition, there could be the occurrence that the user's head is not properly accommodated inside the helmet 10 so that the safety offered by the helmet is reduced.

According to what it has been previously stated, if the user feels that the helmet does not fit properly over his head, he can adjust the comfort liner 40 of the helmet 10 according to the invention by operating on the adjustable device 50.

As a matter of fact, in order to adjust the internal height of the helmet 10, the user can release, by exerting a pull action, the coupling between the suspension liner device 60 of the adjustable device 50 and the anchor means 90.

If, for example, the first pins 81 of each coupling means 80 were previously inserted in the top central hole 94C of the anchor surface 93 (see FIG. 16), by inserting the first pins 81 of each coupling means 80 in the middle central hole 94B or in the bottom central hole 94A (see FIG. 17), the internal height of the helmet 10 can be reduced.

Similarly, if the comfort liner exerts an excessive pressure over the top portion of the user's head, if each coupling means 80 were previously inserted in the bottom central holes 94A (see FIG. 17), by inserting the first pins 81 in the top central holes 94C (see FIG. 16) or in the middle central holes 94B, the internal height of the helmet can be increased, eliminating any pressure point over the top portion of the user head.

Advantageously, by operating on the adjustable device 50 it is also possible to change the angle on which the helmet sits on the head of the user.

As a matter of fact, by inserting the coupling means 80 at the front and at the rear of the helmet in central holes 94 at different locations, the slope of the adjustable device 50 can be changed from its original configuration.

Figure 19:
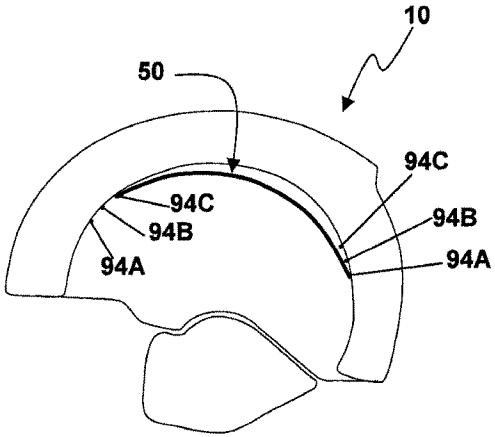

In this way, if for example, after having adjusted the internal height of the helmet by coupling at the front and at the rear the coupling means 80 of the adjustable device 50 with the middle central holes 94B of the anchor means 90, the user feels that the adjustable device 50 exerts a greater pressure over the frontal part of the top portion of the head with respect to the rear part, he has the opportunity to adjust the slope of the adjustable device 50 by inserting the coupling means 80 in the top central holes 94A at the front and in the bottom central holes 94C at the rear (see FIG. 19).

Figure 18:
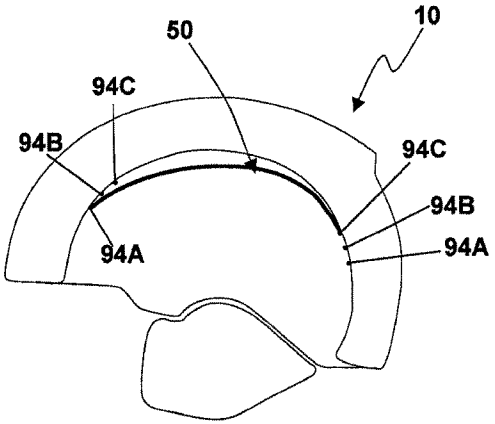

Alternatively, if for example, the user feels that the adjustable device exerts a greater pressure over the rear part of the top portion of the head with respect to the frontal part, by inserting the coupling means 80 at the front in the bottom central holes 94A and at the rear in the top central holes 94C the user has the opportunity to eliminate any pressure point (see FIG. 18).

Of course, besides the above examples, other configurations of the helmet 10 are made possible by the adjustable device 50 in order to satisfy different specific needs of the user.

The specific shapes of the coupling means 80 and of the corresponding anchor points 90 from one side allow an easy engagement between them, on the other side permit a firm connection of the adjustable device 50 to the impact absorbing liner 30. As a matter of fact, as it is shown in FIG. 14, after the insertion of the first pin 81 inside the selected anchor point 94, the suspension liner 60 is subjected to a pull action along a direction schematically represented by the reference F in FIG. 14.

Such pull action forces the surface 84 of the first pin 81 to catch the anchor point 94 and, at the same time, permits that also the second pin 86 can be inserted inside the selected anchor point 94. In this way it is guaranteed that the first pin 81 remains in its proper engagement position and it is eliminated the risk that an unintentional disengagement between coupling means 80 and anchor means 90 can occur.

As a matter of fact, in order to detach the coupling means 80 from the anchor means 90, the user needs firstly to bend each terminal end of the suspension liner device 60, such bending allowing the release of the second pin 86 from the anchor point 94.

Secondly, the user has to pull the rounded head of the first pin 81 along axis $Z_L$, i.e. a direction perpendicular to that of the anchor surface 93.

The two smaller holes 96 provided at the sides of each central hole 95 allow the elastic deformation of the central hole and, as a consequence, the release between the coupling means 80 and the anchor means 90.

From the above description it is clear that the helmet according to the present invention has characteristics suitable to advantageously solve the problems and drawbacks set out in the prior art. In particular, by using the adjustable device 50, it is possible for the user to customize the helmet internal height and angle according to his own personal preference.

Moreover, the provision of the coupling between a male (coupling means 80) and a female receiver (anchor means 90) provides a firm connection of the comfort liner to the impact absorbing liner by improving not only the comfort but also the safety of the helmet.

The present invention has been described with reference to a preferred embodiment, but mechanically equivalent solutions are foreseeable falling within the scope of the following claims.

The invention claimed is:

1. A helmet comprising:

an impact absorbing liner and a comfort liner, the comfort liner comprising at least one adjustable device which comprises a central body that, during use of the helmet, is positioned at a top of a user's head, the adjustable device being adjustably fastened to the impact absorbing liner of the helmet by coupling means provided at ends of the adjustable device;

wherein the coupling means are removably engaged inside corresponding anchor means, the anchor means provided at a front and at a rear of the impact absorbing liner of the helmet, each of the anchor means having a plurality of different anchor points one of which the coupling means is selectively engaged with; and wherein, by changing the anchor points with which the coupling means of the adjustable device are engaged by moving the coupling means at one or more of the front and the rear of the impact absorbing liner, conformation and slope of the adjustable device are correspondingly adjusted relative to the impact absorbing liner.

2. The helmet of claim 1, wherein the adjustable device comprises a cushioning pad and a liner suspension device.

3. The helmet of claim 2, wherein the liner suspension device comprises the central body from which a plurality of appendices protrudes outwardly, the coupling means of the adjustable device being provided on a top surface of each appendix of the plurality of appendices.

4. The helmet of claim 3, wherein the central body has a rectangular shape, with each appendix protruding at a corner of the central rectangular body along a direction of an angle with respect to a longitudinal axis of the body.

5. The helmet of claim 4, wherein the angle is in a range of between 30° and 50°.

6. The helmet of claim 2, wherein the cushioning pad comprises a top moulded cushion which is partially overlaid by a foam layer, the cushioning pad being provided with a central opening.

7. The helmet of claim 2, wherein the adjustable device is made by directly injecting the liner suspension device onto the cushioning pad.

8. The helmet of claim 3, wherein the coupling means comprise a first pin having a mushroom shape which extends orthogonally from the top surface of each appendix, the first pin having a stem which bears a rounded head on a free end of the stem.

9. The helmet of claim 8, wherein the rounded head has an asymmetrical shape with respect to a longitudinal axis of the stem.

10. The helmet of claim 8, wherein the coupling means further comprise a second pin having a rounded head with a height less than that of the first pin.

11. The helmet of claim 1, further comprising an external shell positioned over the impact absorbing liner.

12. The helmet of claim 1, wherein the anchor means are positionable at the front and at the rear of the impact absorbing liner in areas adapted to substantially correspond to a frontal bone and to an occipital bone of the user, the anchor means at the front and rear of the impact absorbing liner being arranged symmetrically in two by two manner with respect to a central vertical symmetry plane of the helmet.

13. The helmet of claim 1, wherein the anchor means are of polymeric material and held within the impact absorbing liner.

14. The helmet of claim 1, wherein each of the anchor means has a bottom profile from which supporting means extend in a direction substantially orthogonal to a top surface of the bottom profile, the supporting means supporting an anchor surface along a plane substantially parallel to plane on which lies the bottom profile.

15. The helmet of claim 14, wherein the anchor surface for each anchor means is provided with the plurality of different anchor points, the anchor points being arranged along a longitudinal axis of the anchor surface.

16. The helmet of claim 15, wherein each anchor point is composed by a central hole to which two smaller holes extend symmetrically in a direction perpendicular to the longitudinal axis of the anchor surface.

17. The helmet of claim 16, wherein the adjustable device comprises a liner suspension device, wherein the liner suspension device comprises a central body from which a plurality of appendices protrudes outwardly, the coupling means of the adjustable device being provided on a top surface of each appendix of the plurality of appendices, wherein the coupling means comprise a first pin having a stem which bears a rounded head on a free end of the stem, wherein a diameter of the central hole of each anchor point is smaller than an outer profile of the rounded head of the first pin.

18. The helmet of claim 1, wherein the anchor points for each of the anchor means are spaced apart at each of the front and rear of the impact absorbing liner.

19. The helmet of claim 1, wherein by changing the anchor points with which the coupling means of the adjustable device are engaged by moving the coupling means at one or more of the front and the rear of the impact absorbing liner, conformation and slope of the central body are correspondingly adjusted relative to the impact absorbing liner.

20. A helmet comprising:

an impact absorbing liner and a comfort liner, the comfort liner comprising at least one adjustable device which comprises a cushioning pad that, during use of the helmet, is positioned at a top of a user's head, the adjustable device being adjustably fastened to the impact absorbing liner of the helmet by coupling means provided at ends of the adjustable device;

wherein the coupling means are removably engaged inside corresponding anchor means, the anchor means provided at a front and at a rear of the impact absorbing liner of the helmet, each of the anchor means having a plurality of different anchor points one of which the coupling means is selectively engaged with; and wherein, by changing the anchor points with which the coupling means of the adjustable device are engaged by moving the coupling means at one or more of the front and the rear of the impact absorbing liner, the cushioning pad is correspondingly adjusted in position relative to the impact absorbing liner, thereby providing different orientation of the helmet relative to the user's head.

21. The helmet of claim 1, wherein, by changing the anchor points with which the coupling means of the adjustable device are engaged by moving the coupling means at one or more of the front and the rear of the impact absorbing liner, the central body is adjusted to either align with, or be spaced at one of a plurality of heights below, the impact absorbing liner.

22. The helmet of claim 1, wherein, by changing the anchor points with which the coupling means of the adjustable device are engaged by moving the coupling means at one or more of the front and the rear of the impact absorbing liner, the central body is adjusted to either slope uniformly with, or slope toward the front or the rear of, the impact absorbing liner.

23. The helmet of claim 1, wherein each of the anchor means has a plurality of different anchor points, only one of the anchor points being selectively engaged with a corresponding of the coupling means at any given time.

* * * * *